US005890322A

United States Patent [19]

Fears

[11] Patent Number: 5,890,322

[45] Date of Patent: Apr. 6, 1999

[54] METHOD AND APPARATUS FOR PREVENTING THE FORMATION OF ICE DAMS AND ICICLES ON THE ROOF OF A HOUSE

[76] Inventor: Clois D. Fears, 4871 Cole Rd., Murrysville, Pa. 15668

[21] Appl. No.: 923,033

[22] Filed: Sep. 3, 1997

[51] Int. Cl.[6] ..... E04H 9/00

[52] U.S. Cl. ..... 52/1; 52/302.1; 454/341; 454/365; 340/580; 340/583

[58] Field of Search ..... 52/302.1, 1; 361/695, 361/694; 340/580, 581, 582, 583; 454/341, 365, 366

[56] References Cited

U.S. PATENT DOCUMENTS

| | | | |
|---|---|---|---|
| 3,579,930 | 5/1971 | Murphy | 454/366 X |
| 3,801,779 | 4/1974 | Ver Sluis | 340/583 X |
| 4,122,660 | 10/1978 | Canavan | 340/580 X |
| 4,416,415 | 11/1983 | Kolt | 454/366 X |
| 5,487,247 | 1/1996 | Pigg | 52/302.1 X |
| 5,720,661 | 2/1998 | Yoshizawa et al. | 454/341 |

*Primary Examiner*—Creighton Smith
*Attorney, Agent, or Firm*—James Ray & Associates

[57] ABSTRACT

A method and apparatus for preventing and/or minimizing the formation of ice dams and icicles on a roof of a building having an unheated attic under said roof, which involves the steps of: (1) determining if there is an accumulation of snow on the roof, (2) determining ambient outdoor air temperature, (3) determining the temperature of air in the attic and (4) if there is an accumulation of snow on the roof and if the ambient outdoor air temperature is at or below freezing and if the attic air temperature is sufficient to cause melting of the snow on the roof, exhausting air from the attic.

20 Claims, 3 Drawing Sheets

METHOD AND APPARATUS FOR PREVENTING THE FORMATION OF ICE DAMS AND ICICLES ON THE ROOF OF A HOUSE

FIELD OF THE INVENTION

This invention relates generally to a method and apparatus for preventing the formation of ice dams and icicles on the roof of a house. More particularly, this invention relates to a method and apparatus for preventing the formation of ice dams and icicles on the roof of a house or other small building by ventilating attic air to control its temperature, as necessary, to prevent melting of accumulated snow on the roof when ambient outdoor air temperature is at or below the freezing temperature of water.

BACKGROUND OF THE INVENTION

It is well known in the United States, at least, that the formation of ice dams and icicles on the roofs of homes and other small buildings in winter weather is responsible for an excessive amount of damage to the homes, buildings and even the contents therein. The causes of ice damming and icicles are also well known, namely that when accumulated snow on a sloped roof top is caused to melt while ambient outdoor air temperatures are at or below the freezing temperature of water, or drop to such temperatures, the melt run-off flows downwardly on the sloped roof until it reaches an area of colder temperature, that is, sufficiently colder than the melt run-off is causing it to re-freeze, which normally occurs along the lower edge of the roof line, and/or within gutters and downspouts. Even though the ambient outdoor air temperature may not be warm enough to cause initial melting of such snow, such melting may nevertheless result due to other causes, such as from a rise in temperature within the unheated attic area of the home or building resulting from heat that escapes into the unheated attic area from the heated rooms therebelow. This rise in temperature can be more than insignificant as a snow covered roof acts as an excellent insulation to prevent heat loss through the snow covered roof.

While some older homes and buildings may have heated attics, present day home building practices usually provide an unheated attic, or at least an unheated air space between the top floor ceiling and the roof structure. Because such unheated attics and air spaces tend to become exceptionally cold in the wintertime, and exceptionally warm in the summertime, it is common practice to insulate the ceilings in the upper floors of the home or building from such unheated attics or air spaces, thereby insulating the living quarters from the outdoor air temperature, whether hot or cold. While the top floor ceiling is normally insulated, it is not normal practice to insulate the roof structure over the attic or air space. Thus, heat loss can normally be expected through the roof structure itself and while a snow cover will tend to insulate the attic air space, it does little to prevent heat loss into the roof structure itself. Accordingly, even though the attic air temperature may be only slightly above a freezing outdoor ambient air temperature, such a slight degree of warmth can be expected to warm the roof structure sufficiently to melt a considerable snow accumulation on the roof.

Normally, the melt run-off, as described above, will flow downwardly on a sloped roof under the snow cover until it reaches an area which is at or below the freezing temperature, such as roof surfaces not directly adjacent to the slightly warmed attic area, like the overhang area of the roof over the facia, and/or in gutters and downspouts, where the melt run-off then re-freezes to form ice. As the mass of such re-frozen run-off builds up, it can form what is commonly referred to as an "ice dam", which may form at the edge of the roof and tend to block the path of additional melt run-off. When ice dams form in gutters and downspouts, the gutters and downspouts can become blocked so that the run-off will overflow the edges of the gutters dripping downwardly to form icicles, which can accumulate and grow over time to very considerable sizes. It is of course well known that large icicles can present a significant danger to persons who must pass thereunder, not to mention damage to the gutters and downspouts themselves as a result of the weight of such icicles. In addition to the threat to personal safety and possible damage to gutters and downspouts, damage often results from the fact that the additional run-off, if so blocked at or near the edge of the roof by an ice dam, will tend to cause the blocked melt run-off to pool or back-up, seeping under the roof shingles and into the house or building so that the supporting wooden roof structure under the roof shingles not only becomes wet and water damaged, but the run-off can further seep or leak through the roof structure to cause water damage to the building walls and wall structures and even the building contents.

Unfortunately, traditional methods to alleviate the problems of ice dams and icicles are addressed primarily to treating the symptoms rather than the causes, in that home and building owners may often find themselves out-of-doors in cold winter weather knocking down icicles and/or chipping away ice dams. It is even more unfortunate that this effort itself often leads to damage to roof shingles, gutters and downspouts, with the very strong probability that the cycle will be repeated, with the ice dams and icicles reforming again.

One system that is available on the market to treat the causes of ice dams and icicles is the installation of one or more lengths of electrical heating cable which are usually installed in a zig-zag pattern adjacent to and along the lower edge of the roof. When properly installed, these heating cables are intended to heat at least certain roof areas to maintain one or more open molten water pathways along the edge of the roof thereby permitting molten run-off access to the gutters, to thereby prevent the formation of ice dams along the edge of the roof. To be completely effective, however, these electric heating cables should also be installed along the full width of the gutters and full length of the downspouts to a lever below grade, which unfortunately, is seldom the case.

In addition to the above discussed prior art concerning problems caused in winter weather, it is acknowledged that attic exhaust fans are well known which are used to overcome problems caused in hot summer weather. Such prior art attic fans normally include an electric motor driven fan adapted to exhaust exceptionally hot air from the attic of a home or building. Such exhaust fans are usually disposed at a high point of the attic ceiling, normally adjacent to a gable peak or apex between a pair of sloped roof surfaces. Such fans are generally mounted within a circular opening directly through the roof structure, such that the fan blade is aligned with and parallel to the roof, with the electric motor operatively connected to the fan blade, extending downwardly into the attic below the fan blades, and a "mushroom cap" type of cover secured to the roof directly over the fan blades to prevent the ingress of rain water and the like. A screen is also normally provided below the fan blades to prevent the ingress of insects and other unwanted solid debris. In the prior art, such exhaust fans have been solely utilized for the purposes of exhausting excessively hot attic air from the attic in summer weather to prevent heat conduction into ceiling surfaces therebelow, thereby assisting in efforts to keep the building cool with an air conditioning system. Indeed, despite the fact that the ceilings may be well insulated, such attic exhaust fans are well known to reduce electricity usage and bills by reducing air conditioner use.

Such attic fans of the prior art normally have a thermostatically controlled on-off switch which is adapted to turn the fan "on" when attic air reaches a temperature of 105° F. to 115° F. Even though the building ceiling is usually insulated against ambient air in the attic, it is known that, at least during exceptionally hot weather, enough heat is conducted through the insulated ceiling to warm such a ceiling and the air temperature in the upper rooms of the building, thereby reducing the effect of the air conditioning system in the building.

SUMMARY OF THE INVENTION

This invention is predicated upon the development of a method and apparatus to prevent the formation of ice dams and icicles on the roof of a home or other building by controlling the air temperature in the attic in the wintertime to maintain a temperature level which is insufficient to melt accumulated snow on the roof as long as the outdoor ambient air temperature is at or below the freezing temperature of water. Thus, by controlling air temperature in the attic, melt run-off on the area of roof over the attic can be prevented or minimized, while the outside ambient air temperature is at or below freezing, thereby preventing or minimizing any significant re-freezing of such melt run-off as will cause formation of significant ice dams and icicles. It follows that the snow will therefore remain on the roof until such time as the ambient air temperature is sufficient to permit melting (or sublimation) of the snow without the risk of any significant re-freezing before the melt run-off is drained away from the home or building.

In its simplest term, therefore, the method of this invention merely involves the steps of determining if there is a significant accumulation of snow on the roof, and at the same time determining both the temperature of air in the attic, and the ambient outdoor air temperature. Then, if there is an accumulation of snow on the roof, and if attic air temperature is sufficient to cause melting of such snow accumulation, and if the outdoor ambient air temperature is low enough to cause re-freezing of any melt run-off, then the warm attic air is exhausted from the attic until such time that its temperature is reduced to a level insufficient to cause such snow melting. Clearly, if melt is prevented, or at least significantly minimized, then the risk of any significant re-freezing is also greatly minimized to virtually eliminate any risk of forming any significant ice dams and icicles.

In essence, the apparatus of this invention merely comprises an exhaust fan adapted to exhaust warm air from the attic to the outdoor atmosphere, a means for determining whether there is any accumulation of snow of the roof, a means for determining ambient outdoor air temperature, a means for determining the temperature of the attic air, a control means to turn-on the exhaust fan when there is an accumulation of snow on the roof and attic air temperature is sufficient to cause melting of such snow and ambient outdoor air temperature is low enough to cause re-freezing of melt run-off. The exhaust fan is thermostatically controlled by the results of these determinations, specifically, the temperature of the air in the attic, such that if there is an accumulation of snow on the roof and ambient outdoor air temperature is at or below freezing, the exhaust fan will be turned on when the attic air warms to a level that will cause the snow on the roof to melt. By turning on the exhaust fan, the warmed attic air will be expelled from the attic and replaced by the ingressing, ambient outdoor air which is below the freezing temperature of water. When the attic air temperature cools to a level where it cannot melt any snow on the attic roof, the exhaust fan is shut-off.

In view of the fact that attic exhaust fans for summertime use are well known as described above, this invention is further based on the use of such a prior art fan for both the prior art summer benefits as well as the winter benefits as taught herein. Accordingly, such a prior art attic exhaust fan intended for summertime use, is modified pursuant to another embodiment of this invention, to include the above-described controls as necessary to prevent melting of accumulated snow on the roof, as well as to prevent overheating of the attic in hot summer weather.

OBJECTS OF THE INVENTION

The primary object of this invention is to provide a method and/or apparatus that will prevent and/or minimize the formation of ice dams and icicles on the roofs of homes and other buildings.

Another object of this invention is to provide a simple method, including simple and low cost apparatus for effecting the method, for preventing and/or minimizing the formation of ice dams and icicles on the roofs of homes and other buildings.

Still another object of this invention is to provide a simple and low cost apparatus for preventing and/or minimizing the formation of ice dams and icicles on the roofs of homes and other buildings, which merely involves controlling the temperature of air in the attic area under a snow covered roof to prevent significant melt run-off, thereby preventing and/or minimizing the probability for any significant re-freezing thereof.

A further object of this invention is to provide a simple and low cost apparatus for exhausting warm air from an unheated attic when there is an accumulation of snow on the roof and ambient outdoor temperatures are at or below the freezing temperature of water, thereby preventing any melting of the accumulated snow which could otherwise cause the formation of ice dams and icicles on the roof, gutters and downspouts.

Still another object of this invention is to provide a simple exhaust fan for exhausting warm air from an unheated attic when there is an accumulation of snow on the roof and ambient outdoor temperatures are at or below the freezing temperature of water, thereby preventing any melting of the accumulated snow which could otherwise cause the formation of ice dams and icicles on the roof, gutters and downspouts.

An even further object of this invention is to provide a simple exhaust fan for venting warm air from an unheated attic which includes control means for determining whether there is an accumulation of snow on the roof, the ambient outdoor air temperature and the attic air temperature, as necessary, to control the fan operation to prevent any melting of accumulated snow which could otherwise cause the formation of ice dams and icicles on the roof, gutters and downspouts.

A still further object of this invention is to provide a combination ventilation fan for venting air from an unheated attic to exhaust excessively hot air in the summertime and exhaust even slightly warmed air in the wintertime, as may be necessary, to prevent melting of any accumulated snow on the roof when ambient outdoor air temperature would cause re-freezing of any melt run-off.

An even further object of this invention is to convert a conventional attic exhaust fan as utilized to vent exceptionally hot air in the summertime, to an exhaust fan adequate to exhaust slightly warmed air in the wintertime, as may be necessary, to prevent melting of any accumulated snow on the roof when ambient outdoor temperature would cause re-freezing of any melt run-off.

These and other objects and advantages of this invention will become apparent from a better understanding of the following detailed description of the invention.

DESCRIPTION OF THE PREFERRED EMBODIMENTS OF THE INVENTION

Figure 1:
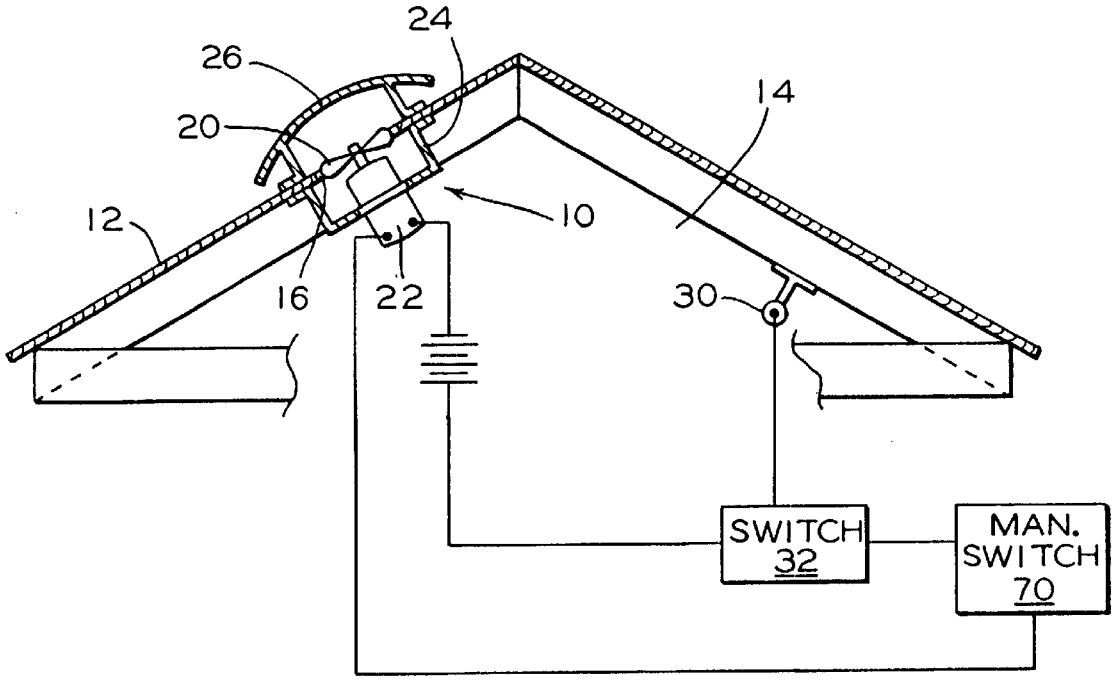
FIG. 1 is a schematic view of a manually controlled attic exhaust fan illustrating a simple apparatus in accordance with a presently preferred, low-cost, embodiment of this invention, which includes only a means for determining attic air temperature and a switch responsive thereto.

Prior to proceeding with a detailed description of the subject invention, it is noted that for the sake of clarity, identical components which have identical functions have been identified with identical reference numerals throughout the several views of the attached drawings.

Figure 3:
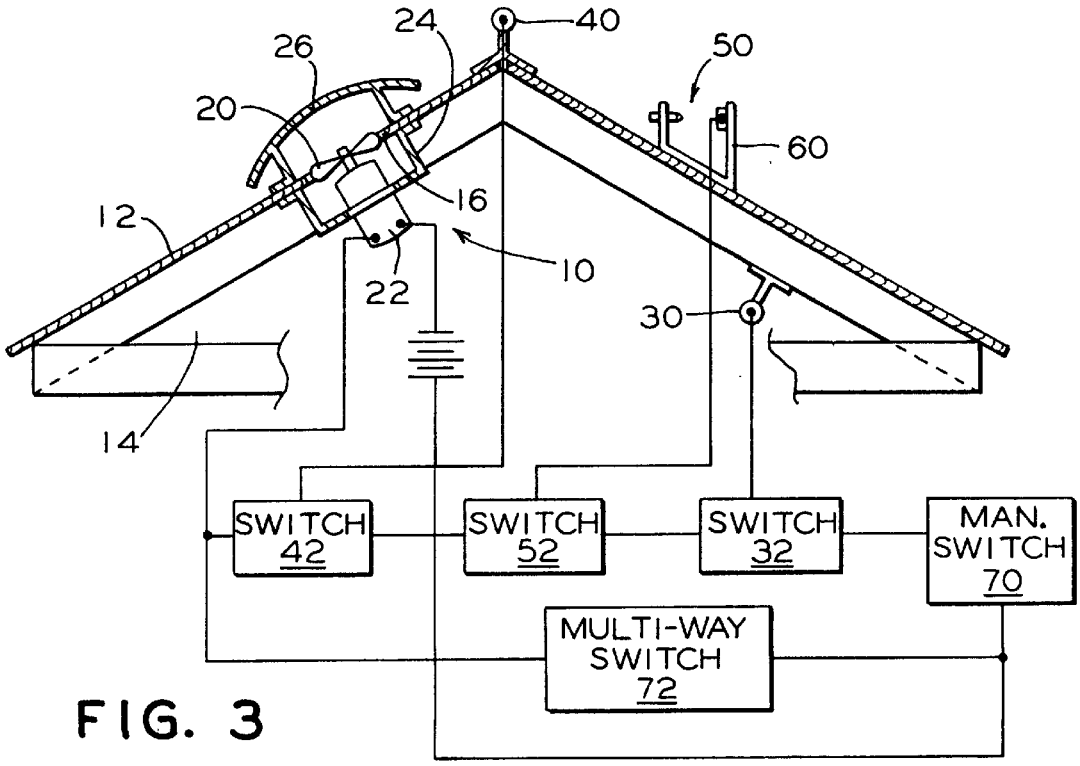
FIG. 3 is a schematic view of a fully automatically controlled attic exhaust fan illustrating an even more preferred, but highest cost apparatus in accordance with still another presently preferred embodiment of this invention, which in addition to the embodiment illustrated in FIG. 2 further includes means for determining whether there is an accumulation of snow on the roof and a switch responsive thereto.

Reference to FIG. 3 will illustrate a presently preferred, fully automatic embodiment of the attic exhaust fan 10 of this invention as ideally mounted to the roof structure 12 of a house or other building (not shown) to exhaust attic air from attic 14 through the opening or aperture 16 extending through roof structure 12. As illustrated, the exhaust fan 10 includes a fan blade structure 20, axially and rotatably attached to an electric motor 22 retained in place by a support structure 24. A rain cover 26, is attached to the supporting structure 24, or to the roof structure 12, to provide a protective shield over fan blade structure 20 and opening 16, thereby preventing the ingress of rain and other falling debris into attic 14 via opening 16. A screen member (not shown) is normally provided to prevent the ingress of insects and wind-blown debris into attic 14 via opening 16. As should be clearly apparent, operation of electric motor 22 is intended to rotate fan blade structure 20 as necessary to exhaust attic air from attic 14 through opening 16 in roof structure 12. As is commonly known to those familiar with the trade, the attic space normally has significant gaps or openings around the periphery of the outside structure walls to prevent the attic space from being air-tight, and in addition, it is common building practice to provide screened air vents (not shown) to the attic, such as in the attic walls under the eves of a gabled roof, or in the soffit or elsewhere, so that clearly, any air exhausted from the attic 14 via attic exhaust fan 10 will immediately cause the ingress of ambient outdoor air through such gaps and screened air vents. If the attic is more air-tight than usual, it may be necessary to provide openings thereinto pursuant to conventional practices. As described above, attic exhaust fans are well known in the trade, as are techniques for providing adequate inlets to permit them to function as intended.

The crux of this invention, therefore, resides not in the structure of the attic exhaust fan 10 itself, but rather in how the fan 10 is used, and the means and techniques for controlling the fan 10 for the purpose of preventing or minimizing the formation of ice dams and icicles on the roofs of houses. For fully automatic operation of the attic exhaust fan 10 as depicted in FIG. 3, the exhaust fan 10 as shown is provided with a means 30 for determining the attic air temperature which is connected to switch 32 which is responsive to means 30. The combination of means 30 and switch 32, is in essence a first thermostatic control power switch, or thermostat, which is included in power circuit to the fan 10. Such thermostatic control power switches 30-32 are well known in the art, and therefore need not be described in detail here, suffice it to say that such a switch, or thermostat 30-32, should be designed to permit the electrical power to be transmitted through switch 32 to the fan 10 when the attic air temperature, as determined by means 30, is sufficient to melt any snow accumulation on the roof 12. Normally such a temperature would be considered to be those temperatures at or above about 33° F. In addition, the means 30 for determining attic air temperature, must of course be located within the unheated attic 14 or attic air space, preferably located where the temperature will be the highest, i.e., at a relatively high location immediately adjacent to the underside of the roof structure 12, where the attic air temperature immediately adjacent to the roof structure 12 is the attic air measured.

In addition to the above, for fully automatic operation of exhaust fan 10 as depicted in FIG. 3, a means for determining the ambient outdoor air temperature 40 is also provided which is connected to switch 42, and is responsive to means 40. The combination of means 40 and switch 42, is in essence a second thermostatic control power switch, or thermostat, which is included in a power circuit to the fan 10. As already noted, thermostatic control switches are well known in the art and need not be described in detail here, suffice it to say that the second thermostatic control switch 40-42, or thermostat, should be designed to permit the electrical power to be transmitted through switch 42 when the determined ambient outdoor air temperature is at or below the freezing point of water, namely at or below about 32° F. In addition, the means for determining ambient outdoor air temperature 40 should preferably be located within a shaded location, out of direct sun light, out of the proximity of any solid object which could influence it's temperature measurement and preferably, at an elevation approximately level with the roof where natural circulation will be assured. Ideally, the means for determining ambient outdoor air temperature 40 could be placed under an eve of the house, but not in the path of any exhausting attic air. In addition to the above considerations, it has been found that the ambient outdoor air temperature can be determined within the attic itself if a temperature measurement is made at a low point within the attic adjacent to the outer edge thereof, particularly where outdoor air may naturally be ventilated into the attic adjacent to a ventilation opening such as a soffit screen or the like.

Figure 5:
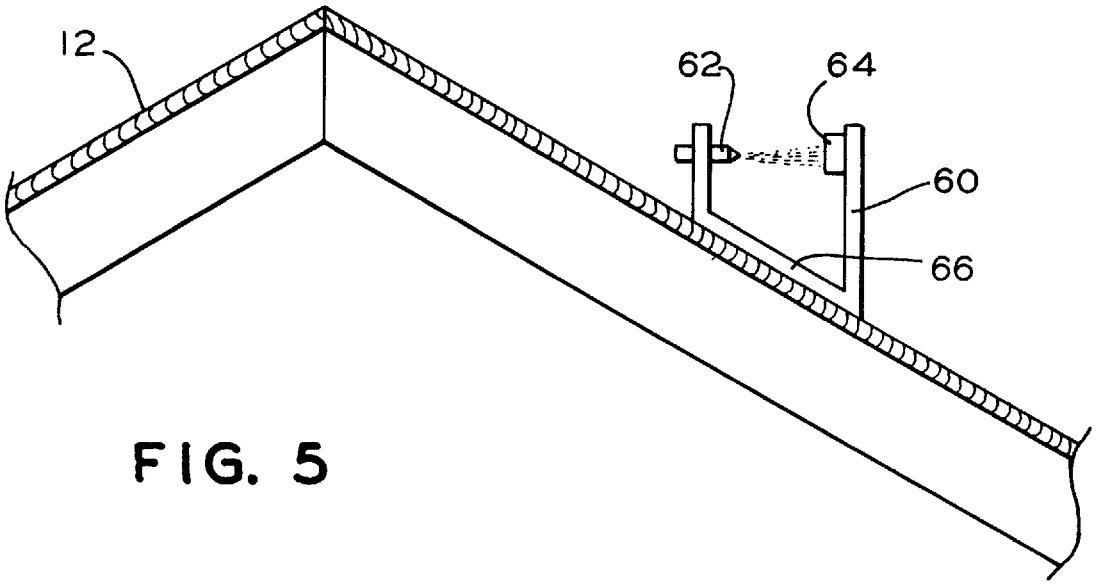
FIG. 5 is a schematic illustration of a means for determining if there is an accumulation of snow on the roof of a house, as may be utilized in the process and apparatus of this invention and incorporates an LED as opposed to a light sensor.
Figure 6:
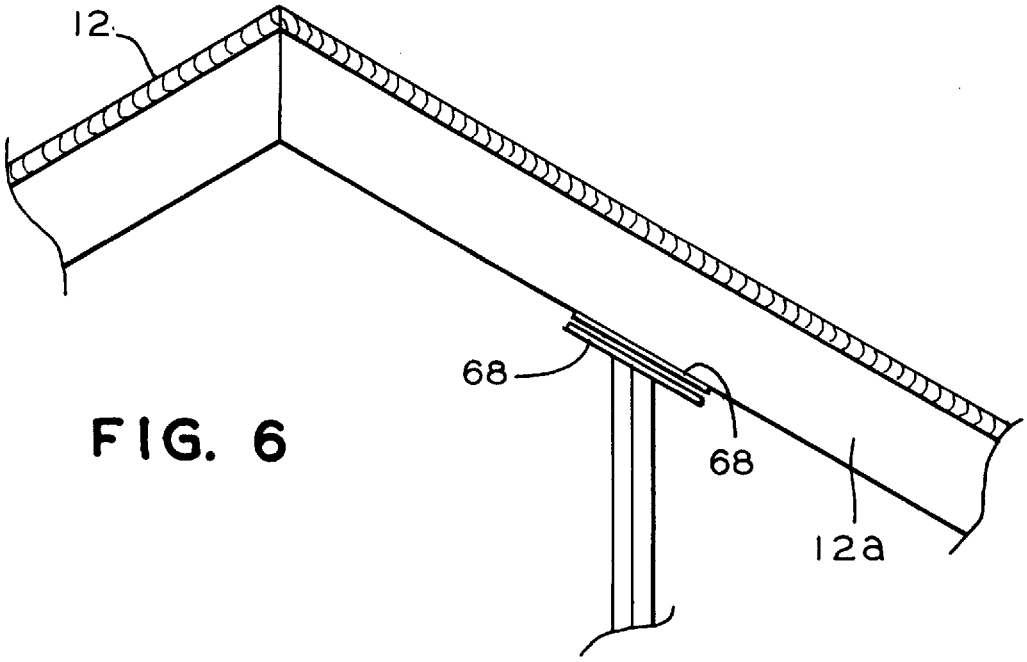
FIG. 6 is a schematic illustration of another means for determining if there is an accumulation of snow on the roof of a house, as may be utilized in the process and apparatus of this invention and incorporates a pair of electrical contacts activated by the weight of any snow on the roof.

Lastly, in addition to the above, for fully automatic operation of fan 10, as depicted in FIG. 3, a means 50 is provided for determining if there is an accumulation of snow on roof structure 12 which is connected to switch 42 and which is responsive to means 40. While such a means 50 is not well known in the art, it should be apparent that such a means 50 could take one of several different forms, two examples of which are illustrated in FIGS. 5 and 6. As shown in FIG. 5, for example, means 50 can include a support structure 60 holding a light emitting diode (LED) 62 spaced from an opposed light sensor 64. Support structure 60 should be secured to roof structure 12 so as to provide a flat surface 66 against the top surface of roof structure 12 with nothing directly thereover. Therefore, normal snow fall will accumulate on flat surface 66, building-up and accumulating between LED 62 and light sensor 64. Upon continued accumulation, the snow will block the light emitted by LED 62 so that it is not sensed by light sensor 64, thereby capable of providing an electronic indication of an accumulation of snow therebetween and on the surface of roof structure 12. As should be apparent, flat surface 66 need not be a perfectly horizontal surface, but is preferably angled to match the slope of the roof to which it is attached. Accordingly, switch 52 is responsive to means 50 and will be activated to permit the power to pass on to exhaust fan 10 only when means 50 indicates that there is an accumulation of snow on surface 66 and accordingly on roof structure 12. The spacing between flat surface 66 and the opposed LED 62 and light sensor 64 thereover, can be varied depending upon the minimum amount of snow depth determined to be sufficient to activate the system. Obviously, an exceptionally small snow depth of 1–2 inches should not present a problem regarding the probability for forming ice dams and icicles. Snow depths of 5 inches, on the other hand, can present problems in causing the formation of significant ice dams and icicles. Accordingly, LED 62 and light sensor 64 should be spaced above surface 66 by a distance of between 2 and 5 inches. As another means for sensing snow on the roof, an identical support structure 60 can be used to hold a pair of electrical sensors such as capacitor plates or conductors (not shown) whereby the presence of snow is determined by changes in capacitance or conductivity between the two electrical contacts.

Reference to FIG. 6 will illustrate another embodiment of means 50 for determining if there is an accumulation of snow on roof structure 12. In this embodiment, a pair of spaced, electrical contact plates 68 are provided, one secured to a roof truss 12*a* (FIG. 6), and the other secured to a structural element independent of roof truss 12*a*, so that the weight of a snow accumulation on roof structure 12 will cause roof truss 12*a* to be slightly deflected downward causing the two electrical contacts 68 to come into contact, thereby electrically indicating an accumulation of snow on roof structure 12.

The operation of the fully automatic apparatus described above with reference to FIG. 3, should be readily apparent. Specifically, when there is an accumulation of snow on roof structure 12, as determined by means 50, means 50 will activate switch 52 to open the electrical circuit there-past so that exhaust fan 10 can be operated. And if the ambient outdoor air temperature is at or below about 32° F., as determined by means 40, then means 40 will open switch 42 to open the electrical circuit there-past so that exhaust fan 10 can be operated. And finally, if the attic air temperature is above about 33° F., as determined by means 30, means 30 will activate switch 32 to open the electrical circuit there-past so that exhaust fan 10 can be operated, to thereby exhaust attic air from attic 14, at least until attic air temperature is reduced to about 32° F. by the incoming ambient outdoor air, thereby preventing any significant melting of the snow accumulation of roof structure 12. If, on the other hand, there is no accumulation of snow on roof structure 12 as determined by means 60, then obviously switch 62 will not be turned on, so that exhaust fan 10 will not be activated. In a like manner, if the outdoor ambient air temperature is above about 32° F. as determined by means 40 then here too, switch 42 will not be turned on, so that exhaust fan 10 cannot be activated. In this way then, exhaust fan 10 will be activated only when the three controlling conditions are met; namely, when there is an accumulation of snow on roof structure 12, outdoor ambient temperature is at or below about 32° F. and attic air temperature is at or above about 33° F.

Figure 2:
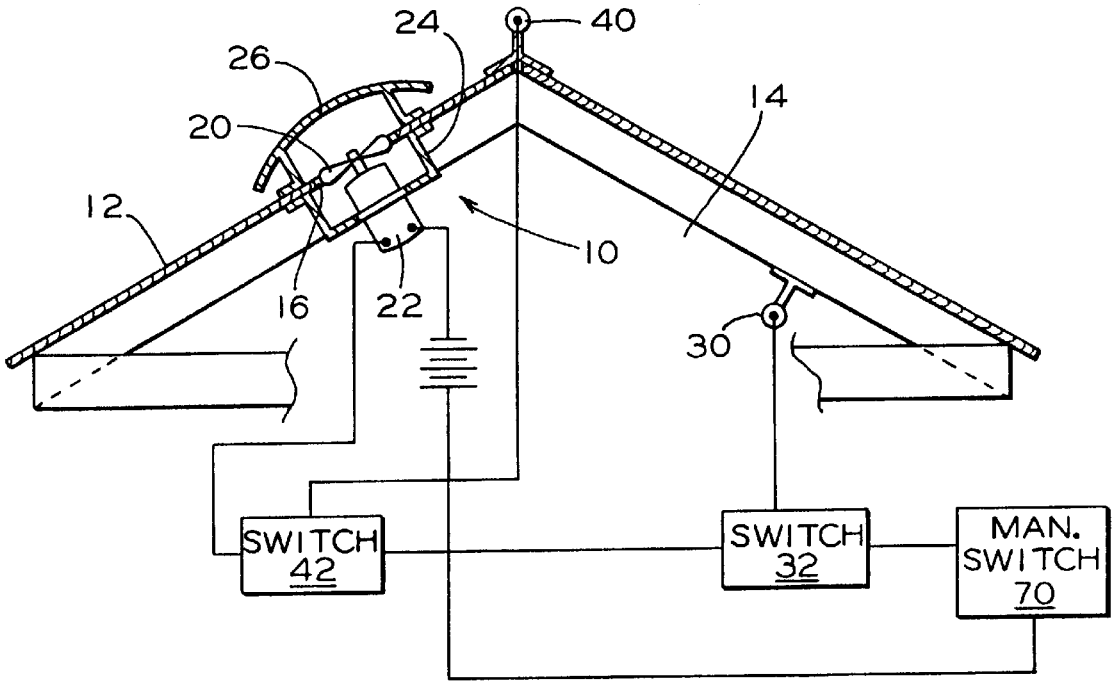
FIG. 2 is a schematic view of a partially automatically controlled attic exhaust fan illustrating a more preferred, but higher cost apparatus in accordance with another presently preferred embodiment of this invention, which in addition to the embodiment illustrated in FIG. 1 further includes means for determining outdoor air temperature and a switch responsive thereto.

It should be appreciated that in some locations, heavy accumulations of snow may be rather uncommon, or at least uncommon during some winter months so that it is possible that the above described fully automatic system may be more than is absolutely essential. On the other hand, it is obvious that a home owner or building owner can easily and readily determine, merely by looking, whether there is an accumulation of snow on his home or building roof. Therefore, the above described apparatus may be perfectly useful even if it does not include a means for determining whether there is an accumulation of snow on the roof structure 12, as indeed this step of the method can easily be performed by the home or building owner/occupant merely by looking to see if there is such an accumulation of snow. Such an apparatus meeting this situation is illustrated in FIG. 2, which is substantially the same as the apparatus shown in FIG. 3, except for the fact that it does not include a means 50 (and switch 52) for determining if there is an accumulation of snow on the roof. In lieu of such a means, this embodiment of the invention merely included a manual switch 70, which the owner/occupant can turn to the "on" position when there is such an accumulation of snow on the roof. Accordingly, the step of determining if there is an accumulation of snow on the roof can be performed by merely visually looking to see if there is snow on the roof and then switch 70 can be a manually switched "on" by the owner/occupant based upon what he/she may see. Therefore, during periods where there is clearly no significant accumulation of snow on the roof, or the probability for such, switch 70 can be left in the "off" position, thereby inactivating the system entirely, as there is no threat or danger of forming any ice dams or icicles. In any embodiment however, it is preferable to include an "off-on" switch 70, so that the exhaust fan 10 can be disconnected from the power source when there is no probability for the formation of ice dams and icicles, such as in the summertime, particularly if the attic exhaust fan is further adapted to exhaust exceptionally warm air in the summertime. In addition, it would be advantageous to include a three-way switch 72, which also includes a by-pass "on" position which could be used to turn on the fan 10, and by-pass all of the other control means in the event there would be a failure in any one of the other control means.

While it is conceivable that one may wish to eliminate the means for determining the outdoor ambient air temperature for similar reasons, this is not something that can be determined by mere visual observation and it is something that can vary widely over short periods of time. Therefore, it is not a recommended procedure that this step of the method be left to the home owner/occupant. Nevertheless, some regions may have such a relatively short winter season or a season of mixed outdoor ambient air temperatures, that the means for determining ambient outdoor air temperatures could also be replaced by a simple manually operated switch, such as "off-on" switch 70. Accordingly, a simple apparatus as illustrated in FIG. 1 could be utilized to activate exhaust fan 10 merely by switching "on" switch 70, which would then function automatically in response only to the attic air temperature.

Figure 4:
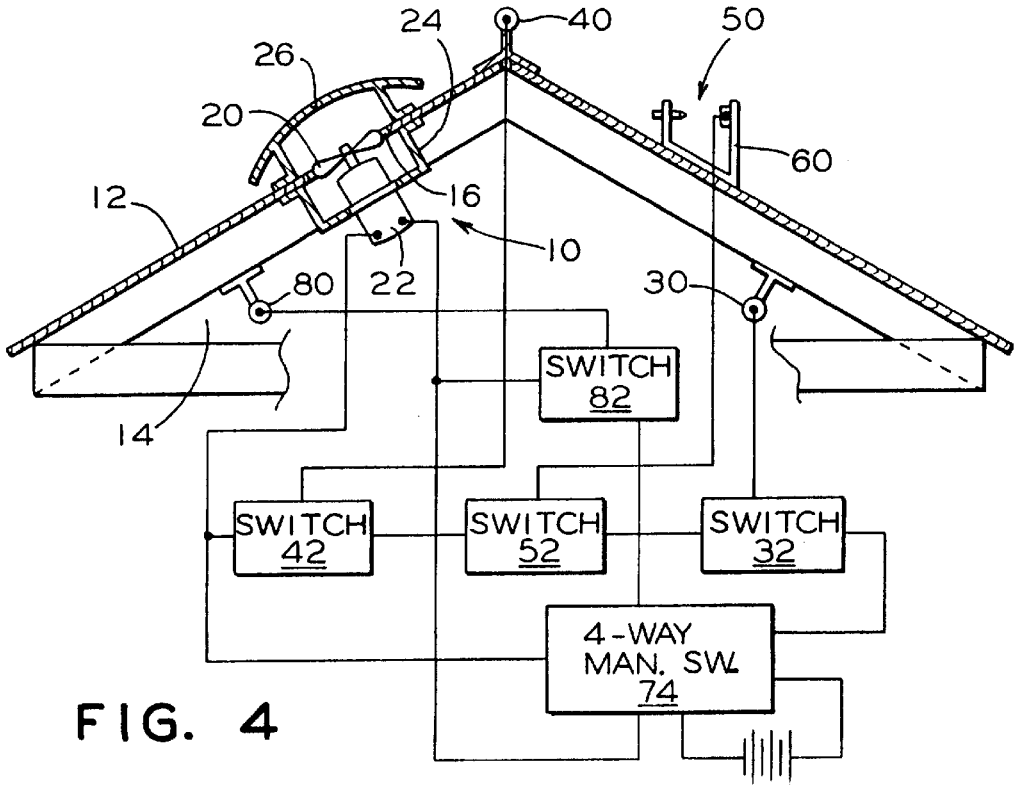
FIG. 4 is a schematic view of an automatically controlled attic exhaust fan including controls adapted to cool attic air temperature in the summertime, as well as being adapted to prevent the formation of ice dams and icicles in the wintertime pursuant to this invention.

Reference to FIG. 4 will illustrate a conventional prior art attic exhaust fan as utilized to exhaust exceptionally hot attic air in the summertime, as modified to incorporate the features of this invention, as necessary to prevent or minimize the formation of ice dams and icicles on the roof to which it is attached. In this embodiment, the exhaust fan 10, as described above with reference to FIG. 3, further includes a third thermostatic control switch 82, responsive to a second means 80 for determining attic air temperature. As is known in the prior art, means 80 and switch 82 are adapted to turn on exhaust fan 10 to exhaust attic air when attic air temperature reaches a temperature of 105° F. to 115° F. As noted above, the purpose for this is to cool the attic somewhat in exceptionally warm summer weather to reduce air conditioning costs during exceptionally warm weather when attic air temperatures can reach well over 115° F. Ideally, a selective, 4-way "summer/winter/off/on" switch 74 is provided to indicate the current season for automatic selective control and to turn the fan 10 "off" and "on" independent of either control circuit if neither automatic function is desired. In addition to such "summer" controls, as described above, the exhaust fan 10 as depicted in FIG. 4, also included the winter weather controls as described with regard to FIG. 3. When the summer/winter/off/on switch 72 is turned to "summer" use, exhaust fan 10 will function as described above to cool attic 14 when the air therein becomes exceptionally hot. When summer/winter/off/on switch 72 is turned to "winter" use, exhaust fan 10 will function as above described with reference to FIG. 3. While some home owners may prefer to have two separate exhaust fans, one for its summer use and another for its winter use, there is no good reason why both functions cannot be served by a single exhaust fan 10, as obviously utilizing a single fan 10 will be less costly than utilizing two, in addition, it reduces the number of openings 16 that must be cut through roof structure 12.

In the above discussion, the phrase "accumulation of snow on the roof" has been used extensively without any definition of what constitutes such an "accumulation" as necessary to activate the exhaust fan 10. The reason for this is because what constitutes such a significant accumulation of snow on the roof structure 12, as to likely cause ice damming and/or icicles, varies rather widely depending on regions of the country, weather patterns and even design and structure of the home or building itself. While clearly, an accumulation of a foot or more is usually quite threatening, accumulations of 1 inch or less are seldom a problem. On the other hand, accumulations of as little as 3–5 inches can cause problems in some homes or buildings in some regions of the country. Therefore, an accumulation of 3–5 or more inches should be the minimum standard, although this can be varied by the home builder's experiences.

Having described above several preferred embodiments of this invention, it should become readily apparent that a number of modifications and differing embodiments could be utilized without departing from the spirit of the invention. For example, while two techniques have been described for determining whether there is an accumulation of snow on the roof, not to mention visual observation thereof, it is obvious that other techniques and apparatus could be developed and utilized. As should be further apparent from the above discussion, a number of variations can be provided in determining what is "an accumulation of snow" sufficient to activate the system. In view of this fact it can be seen that any such means for determining snow accumulation should preferably be adjustable for the purpose of selecting a snow depth on roof structure 12 at which the system will be activated. In the case of the LED 62 and light sensor 64, as depicted in FIG. 5, such an adjustability can be provided by providing a plurality of vertically aligned apertures in the vertical arms of support 66, so that the LED 62 and light sensor 64 can be positioned where desired with respect to base 66. In a like manner, the spacing between electrical contacts 68 in FIG. 6 can be varied to adjust degree of deflection and, accordingly, the weight of the snow required to cause contact between electrical contacts 68.

In addition to the above, it should be realized that in view of the fact that ambient outdoor air temperatures, as well as attic air temperatures, will likely vary considerably throughout a normal day, that the actual temperature setting for activating the exhaust fan in response to such temperature measurement will probably have to be varied somewhat away from 32° F. and 33° F., as described above, for the purpose of anticipating such temperatures when conditions are such that those temperatures will likely be reached in short order. Specifically, when the ambient outdoor air temperature is above freezing, but nevertheless falling as nighttime approaches, it may be wise to activate the system in advance of the ambient outdoor air temperature actually reaching the activation temperature. It should be apparent that a great number of differing embodiments and modifications could be incorporated without departing from the spirit of the invention and furthermore, that the addition of any one or more of the controls as disclosed herein to an existing attic exhaust fan as may have been manufactured for summertime use or otherwise, would bring such a modified exhaust fan within the bounds of the invention as disclosed and claimed herein.

I claim:

1. A method for minimizing the formation of ice dams and icicles on a roof of a building having an unheated attic under said roof, the steps comprising;

(a) determining if there is an accumulation of snow on said roof, (b) determining ambient outdoor air temperature, (c) determining the temperature of air in said attic, and (d) if there is an accumulation of snow on said roof as determined in step (a), and if said ambient outdoor air temperature is at or below the freezing temperature of water as determined in step (b), and if said attic air temperature as determined in step (c) is sufficient to cause melting of said snow on said roof, exhausting air from said attic.

2. A method for minimizing the formation of ice dams and icicles on a roof of a building having an unheated attic under said roof, according to claim 1, in which said temperature of air in said attic is continuously monitored, and said air is exhausted from said attic until said attic air temperature in not sufficient to cause said snow on said roof to melt.

3. A method for minimizing the formation of ice dams and icicles on a roof of a building having an unheated attic under said roof, according to claim 1, in which said ambient outdoor air temperature is the ambient outdoor air temperature at the elevation of said roof.

4. A method for minimizing the formation of ice dams and icicles on a roof of a building having an unheated attic under said roof, according to claim 1, wherein step (d) is effected with an exhaust fan disposed at an elevated level in said attic.

5. A method for minimizing the formation of ice dams and icicles on a roof of a building having an unheated attic under said roof, according to claim 1, wherein step (a) is effected with an LED spaced from and opposed to a light sensor, such that an accumulation of snow between said LED and said light sensor will block light emitted from said LED to said light sensor thereby indicating a presence of an accumulation of snow.

6. A method for minimizing the formation of ice dams and icicles on a roof of a building having an unheated attic under said roof, according to claim 1, wherein step (a) is effected by at least one weight sensor incorporated into a structure supporting said roof.

7. A method for minimizing the formation of ice dams and icicles on a roof of a building having an unheated attic under said roof, according to claim 1, wherein step (b) is effected by a means for determining said temperature disposed in a shaded area within said ambient outdoor air adjacent to said roof.

8. A method for minimizing the formation of ice dams and icicles on a roof of a building having an unheated attic under said roof, according to claim 1, wherein step (b) is effected by a means for determining the ambient outdoor air temperature as such air is naturally circulated into said attic.

9. A method for minimizing the formation of ice dams and icicles on a roof of a building having an unheated attic under said roof, according to claim 1, wherein step (c) is effected by a means for determining said temperature disposed within said unheated attic adjacent to said roof.

10. A method for minimizing the formation of ice dams and icicles on a roof of a building having an unheated attic under said roof, according to claim 1, wherein step (d) is effected by a pair of thermostatically controlled switches, a first responsive to a means for determining said ambient outdoor air temperature, and a second responsive to a means for determining said attic air temperature.

11. Apparatus for minimizing the formation of ice dams and icicles on a roof of a building having an unheated attic under said roof, said apparatus comprising;

(a) means for determining if there is an accumulation of snow on said roof, (b) means for determining ambient outdoor air temperature, (c) means for determining the temperature of air in said unheated attic, (d) means for exhausting air from said unheated attic, and (e) control means for activating said means for exhausting air from said unheated attic, responsive to said means for determining if there is an accumulation of snow on said roof, said means for determining ambient outdoor air temperature, and said means for determining the temperature of air in said unheated attic, when there is an accumulation of snow on said attic, and said ambient outdoor temperature is at or below the freezing temperature of water, and said temperature of air in said unheated attic is sufficient to melt said accumulated snow on said roof.

12. Apparatus for minimizing the formation of ice dams and icicles on a roof of a building having an attic under said roof, according to claim 11, in which said means for exhausting air from said unheated attic is an exhaust fan that will exhaust air through said roof from said unheated attic into atmosphere.

13. Apparatus for minimizing the formation of ice dams and icicles on a roof of a building having an unheated attic under said roof, according to claim 11, in which said means for determining the temperature of air in said attic, is a means for constantly monitoring said temperature of said air in said unheated attic, and said control means that will activate said unheated attic exhaust fan to exhaust air from said attic only while said attic air temperature is sufficient to cause melting of said accumulation of snow on said roof.

14. Apparatus for minimizing the formation of ice dams and icicles on a roof of a building having an unheated attic under said roof, according to claim 11, in which said means for determining the ambient outdoor air temperature, is a means for constantly monitoring said ambient outdoor air temperature, and said control means that will activate said unheated attic exhaust fan to exhaust air from said attic only while said ambient outdoor air temperature is at or below the freezing temperature of water.

15. A method for minimizing the formation of ice dams and icicles on a roof of a building having an unheated attic under said roof, according to claim 11, wherein said means for determining if there is an accumulation of snow on said roof, comprises an LED spaced from and opposed to a light sensor, such that an accumulation of snow between said LED and said light sensor will block light emitted from said LED to said light sensor thereby indicating a presence of an accumulation of snow.

16. A method for minimizing the formation of ice dams and icicles on a roof of a building having an unheated attic under said roof, according to claim 11, wherein said means for determining if there is an accumulation of snow on said roof, comprises at least one weight sensor incorporated into a truss supporting said roof.

17. A method for minimizing the formation of ice dams and icicles on a roof of a building having an unheated attic under said roof, according to claim 11, wherein said means for determining the temperature of air in said unheated attic is disposed within said unheated attic adjacent to said roof at a high point of said attic.

18. Apparatus for minimizing the formation of ice dams and icicles on a roof of a building having an unheated attic under said roof, according to claim 11, further including means for exhausting exceptionally hot air from said unheated attic.

19. An attic ventilation system for exhausting air from an unheated attic of a building, said ventilation system comprising;

(a) an exhaust fan operated by an electric motor adapted to exhaust air from said unheated attic, (c) means for determining if there is an accumulation of snow on a roof over said unheated attic, (d) means for determining ambient outdoor air temperature, (e) control means for activating said exhaust fan when air temperature in said unheated attic is at a temperature in excess of above about 33° and said means for determining if there is an accumulation of snow on a roof over said unheated attic indicates a presence of such an accumulation, and said means for determining ambient outdoor air temperature indicates such temperature to be at or below the freezing temperature of water.

20. An attic ventilation system for exhausting air from an unheated attic of a building, according to claim 19, further including a second thermostatically operated control means for activating said exhaust fan when air temperature in said unheated attic is at a temperature in excess of about 105° F.

* * * * *